US006310834B1

(12) United States Patent
Nosaka

(10) Patent No.: US 6,310,834 B1
(45) Date of Patent: Oct. 30, 2001

(54) ELECTRONIC APPARATUS WITH ULTRASONIC MOTOR AS DRIVING SOURCE

(75) Inventor: Naokatsu Nosaka, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/532,487

(22) Filed: Mar. 22, 2000

(30) Foreign Application Priority Data

Mar. 24, 1999 (JP) ..... 11-079059

(51) Int. Cl.[7] ..... G04B 9/00
(52) U.S. Cl. ..... 368/66
(58) Field of Search ..... 368/64, 66, 203–205, 368/157

(56) References Cited

U.S. PATENT DOCUMENTS 4,316,274 * 2/1982 Ushikoshi ..... 368/66

5,835,456 * 11/1998 Farine et al. ..... 368/66

* cited by examiner

*Primary Examiner*—Bernard Roskoski
(74) *Attorney, Agent, or Firm*—Adams & Wilks

(57) ABSTRACT

Residual battery capacity is calculated in an electronic apparatus having an ultrasonic motor driven by a battery based on the revolution speed of the ultrasonic motor. This permits residual capacity to be calculated extremely close to actual battery life with a simplified circuit structure. An electronic watch having an ultrasonic motor as a driving source of a calendar display mechanism is provided with a residual battery capacity display device having a revolution speed detector for detecting a revolution speed of the ultrasonic motor, a memory for storing comparison representing a relationship between detected revolution speed and battery life, and a CPU for determining residual battery life based on the detected revolution speed and the comparison data. An alarm is generated when the battery life is over.

28 Claims, 5 Drawing Sheets

ELECTRONIC APPARATUS WITH ULTRASONIC MOTOR AS DRIVING SOURCE

BACKGROUND OF THE INVENTION

1. Field of the Invention

The present invention relates to a battery residual quantity or capacity display for an electronic apparatus having a battery as a power source and with an ultrasonic motor as a driving source, and more particularly relates to a battery residual quantity or capacity display for an electronic watch having an ultrasonic motor as a driving source of a calendar display mechanism.

2. Description of the Related Art

Although only about ten years has passed since the ultrasonic motor was developed, since it has desirable features including a small size, light weight, high output, excellent controllability, small operating sound, and the like, it has already been adopted in various industrial fields. Particularly, due to the feature of the small size and light weight without using a winding, it has been adopted in an electronic apparatus having a battery as a power source. Inventors of the present invention have already put an electronic watch adopting an originally developed ultrasonic motor as a driving source of a calendar display mechanism to practical use.

Irrespective of whether the ultrasonic motor is made a driving source or not, an electronic apparatus with a battery as a power source, such as an electronic watch, is generally provided with a battery residual quantity display device. This is for notifying the user of the end of the battery life before it is exhausted so that the exchange of the battery can be suitably carried out.

A conventional battery residual quantity display device used for an electronic apparatus with a battery as a power source is constructed such that a reference value is compared with a detected voltage level of a battery voltage by a comparator to judge whether the battery life coming to an end, and the battery life is displayed. The reference value is a voltage corresponding to a drivable voltage of the electronic apparatus, and the detected voltage level is a divided voltage obtained from the battery voltage by a voltage dividing circuit formed by a plurality of voltage dividing resistors.

However, in such a conventional battery residual quantity display device, there is a problem in that since the drivable voltage of an apparatus must be set in view of fluctuation of comparators and voltage dividing resistors, there often occurs a case where it is judged that the battery life come to an end though it can be actually used, and resulting in the problem that the usable period or usable range of the battery becomes short. In brief, there is a problem in that the conventional battery residual quantity display device must display not an actual battery life, but an apparent battery life with a rather larger allowance than desired. Besides, in a conventional battery residual quantity display device in which not only a battery life is displayed but also a battery residual quantity is always displayed, since detected voltage levels must be set by many voltage dividing circuits, there is also a problem in that a circuit scale becomes large.

Moreover, with respect to a battery residual quantity display of an electronic apparatus having an ultrasonic motor as a driving source, in addition to the foregoing problem, there is also a problem as to a large driving current. That is, since a voltage drop occurs by the large driving current in the driving of the ultrasonic motor, when circuit design is made for the battery residual quantity display device using the voltage dividing circuit and the comparator, there is also a difficulty that this voltage drop must also be taken into consideration.

SUMMARY OF THE INVENTION

A first object of the invention is to provide an electronic apparatus having a battery as a power source and an ultrasonic motor as a driving source, in which a state exceedingly close to an actual battery life is detected and that is displayed.

A second object of the invention is to provide an electronic apparatus having a battery as a power source and an ultrasonic motor as a driving source, in which a circuit structure is simplified as compared with a conventional apparatus and a battery residual quantity, not to mention a battery life, can be always displayed.

A third object of the invention is to provide an electronic apparatus having a battery as a power source and an ultrasonic motor as a driving source, in which an alarm can be issued when it is judged that a battery life has come to an end.

A fourth object of the invention is to provide an electronic apparatus having a battery as a power source and an ultrasonic motor as a driving source, in which the ultrasonic motor is made to be hindered from operating when it is judged that a battery life has come to an end.

A fifth object of the invention is to provide an electronic watch having an ultrasonic motor as a driving source of a calendar display mechanism, in which a circuit structure is simplified, while a state exceedingly close to an actual battery life is detected and that is displayed, and a battery residual quantity or capacity can be always displayed.

In order to achieve the first and second objects, in an electronic apparatus having a battery as a power source and an ultrasonic motor as a driving source, a battery residual quantity or capacity display device includes a battery residual quantity display unit, a revolution speed detector for detecting a revolution speed of the ultrasonic motor, a memory in which comparison data are stored, and a control circuit for comparing the revolution speed with the comparison data and for driving the battery residual quantity display unit on the basis of the comparison result.

In order to achieve the third object, in an electronic apparatus having a battery as a power source and an ultrasonic motor as a driving source, a battery residual quantity display device includes a battery residual quantity display unit, a revolution speed detector for detecting a revolution speed of the ultrasonic motor, a memory in which comparison data are stored, and a control circuit for comparing the revolution speed with the comparison data and for driving the battery residual quantity display unit on the basis of the comparison result, and the electronic apparatus includes an alarm controlled by the control circuit when the revolution speed coincides with a minimum effective battery residual quantity value.

In order to achieve the fourth object, in an electronic apparatus having a battery as a power source and an ultrasonic motor as a driving source, a battery residual quantity display device includes a battery residual quantity display unit, a revolution speed detector for detecting a revolution speed of the ultrasonic motor, a memory in which comparison data are stored, and a control circuit for comparing the revolution speed with the comparison data and for driving the battery residual quantity display unit on the basis of the comparison result, wherein the control circuit prohibits driving of the ultrasonic motor when the revolution speed coincides with a minimum effective battery residual quantity value.

In order to achieve the fifth object, in an electronic watch having an ultrasonic motor as a driving source of a calendar display mechanism, a battery residual quantity display device includes a battery residual quantity display unit, a revolution speed detector for detecting a revolution speed of the ultrasonic motor, a memory in which comparison data are stored, and a control circuit for comparing the revolution speed with the comparison data and for driving the battery residual quantity display unit on the basis of the comparison result. The revolution speed detector is realized by a detector which detects a rotation period of a rotor of the ultrasonic motor or a constituent member of a transmission mechanism for transmitting a rotational force to the calendar display mechanism.

DETAILED DESCRIPTION OF THE PREFERRED EMBODIMENTS

Figure 1:
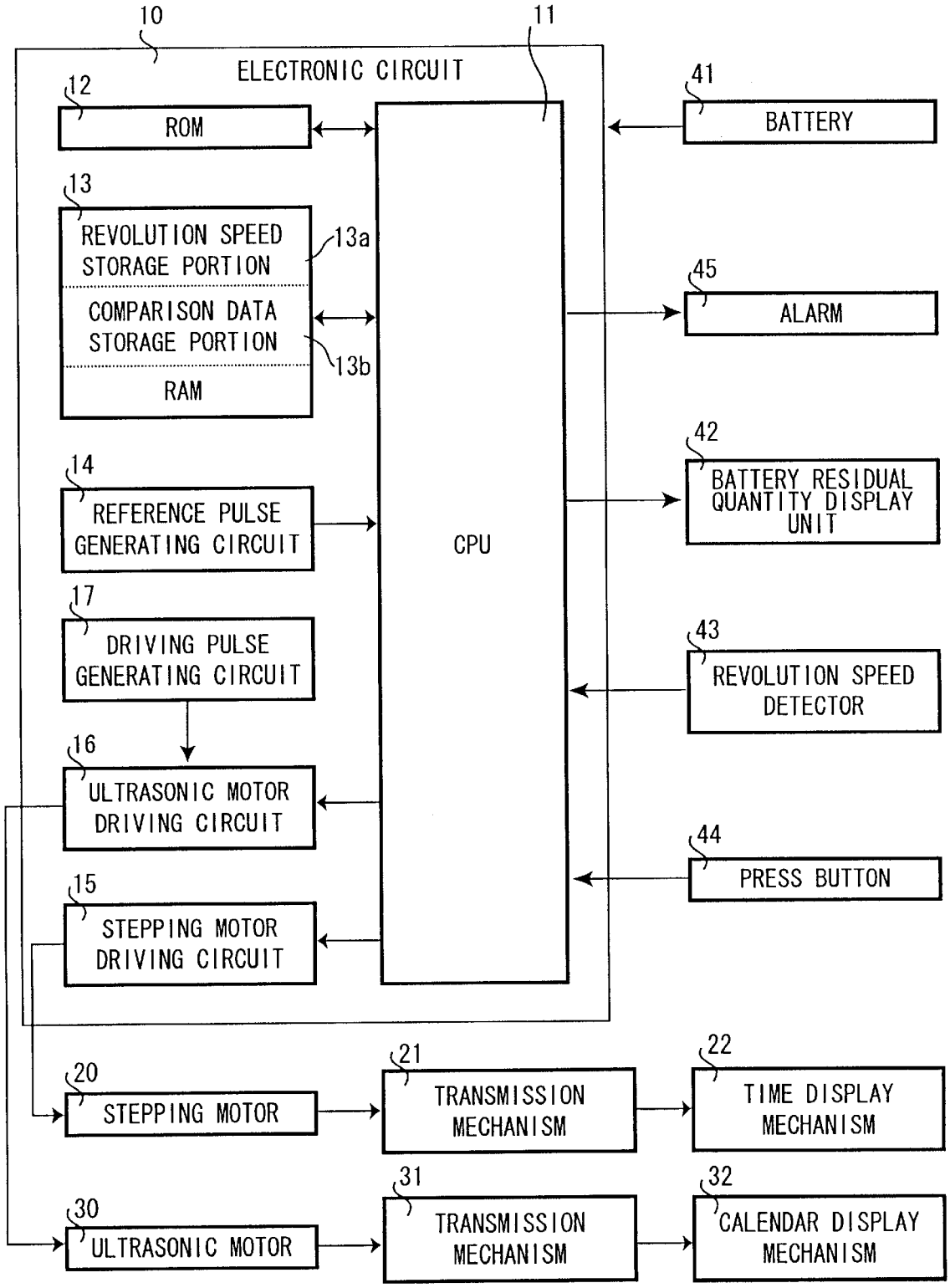
FIG. 1 is a block diagram of an electronic watch of an embodiment of the invention.
Figure 2:
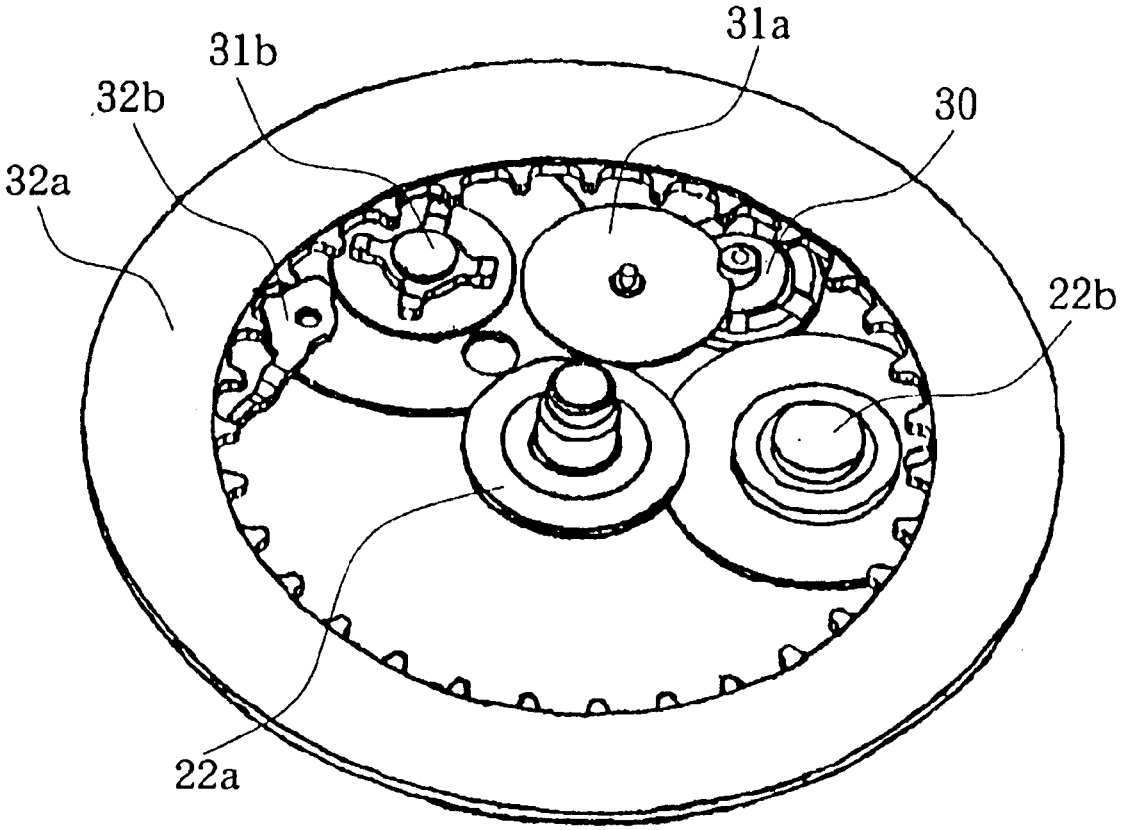
FIG. 2 is a perspective view of a calendar display mechanism used for the electronic watch of FIG. 1.

FIG. 1 is a block diagram of an electronic watch having a battery as a power source and an ultrasonic motor as a driving source for driving a calendar display mechanism according to an embodiment of the invention and FIG. 2 is a perspective view of the calendar display mechanism. The electronic watch includes three display means comprising a time display mechanism 22, a calendar display mechanism 32, and a battery residual quantity display unit 42. The time display mechanism 22 includes a minute wheel 22*a* rotating once every hour, and a cylindrical wheel 22*b* rotating once every 24 hours is driven by a stepping motor 20 through a transmission mechanism 21 comprised of a speed reducing gear train. The calendar display mechanism 32 comprises a day plate 32*a* printed with dates, and a day jumper 32*b* for preventing rotation of the day plate 32*a* until the date is changed is driven by an ultrasonic motor 30 through a transmission mechanism 31 comprised of a speed reducing gear train made of a day rotating intermediate wheel 31*a* and a day rotating wheel 31*b*. An electronic circuit 10 is supplied with electric power from a battery 41, and controls the stepping motor 20 and the ultrasonic motor 30.

The electronic circuit 10 includes a microprocessor (CPU) 11 functioning as a control circuit, a memory (ROM) 12 in which a system program, a processing program, and the like are stored, a memory (RAM) 13 in which processing data and the like are stored, a reference pulse generating circuit 14 for supplying a reference pulse signal of a frequency of 32.768 Hz to the CPU 11, a stepping motor driving circuit 15 controlled by the CPU 11 for driving the stepping motor 20, and ultrasonic motor driving circuit 16 controlled by the CPU 11 for driving the ultrasonic motor, and a driving pulse generating circuit 17 for supplying an ultrasonic pulse signal of a frequency of from 20 KHz to 40 KHz to the ultrasonic motor driving circuit 16. The RAM 13 includes a revolution speed storage portion 13*a* and a comparison data storage portion 13*b*.

The electronic watch of FIG. 1 further includes the battery residual quantity display unit 42 controlled by the CPU 11 for displaying a battery life and a battery residual quantity, a revolution speed detector 43 for detecting the revolution speed of the ultrasonic motor 30 and inputting it to the CPU 11, a press button 44 for inputting date information and the like to correct the display of the calendar display mechanism 32, and an alarm 45.

Figure 3:
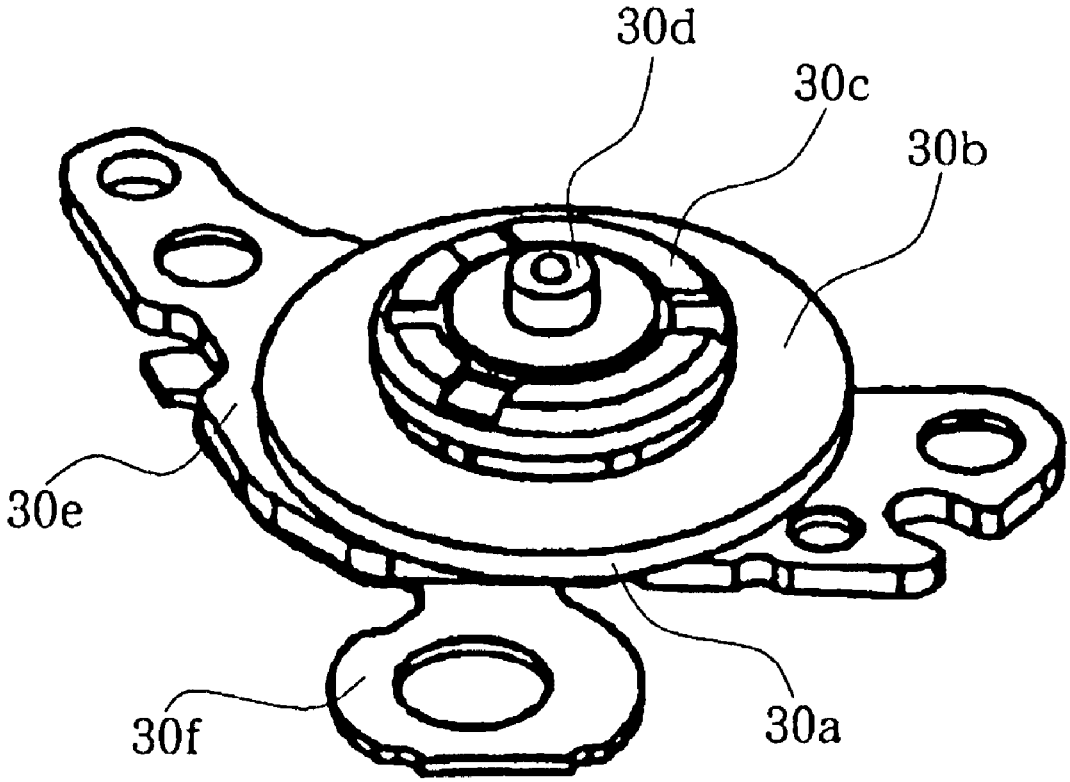
FIG. 3 is a perspective view of an ultrasonic motor for driving the calendar display mechanism used for the electronic watch of FIG. 1.

The ultrasonic motor 30 basically includes, as shown in a perspective view of FIG. 3, a piezoelectronic vibrator 30*a*, a vibrator (stator) 30*b* as a stator, and a rotary body (rotator) 30*c*. The ultrasonic motor 30 further includes a rotor pinion 30*d* engaging with the day rotating intermediate wheel 31*a* of the transmission mechanism 31, a substrate 30*e* for the vibrator 30*b*, and a connection terminal 30*f*.

Figure 4:
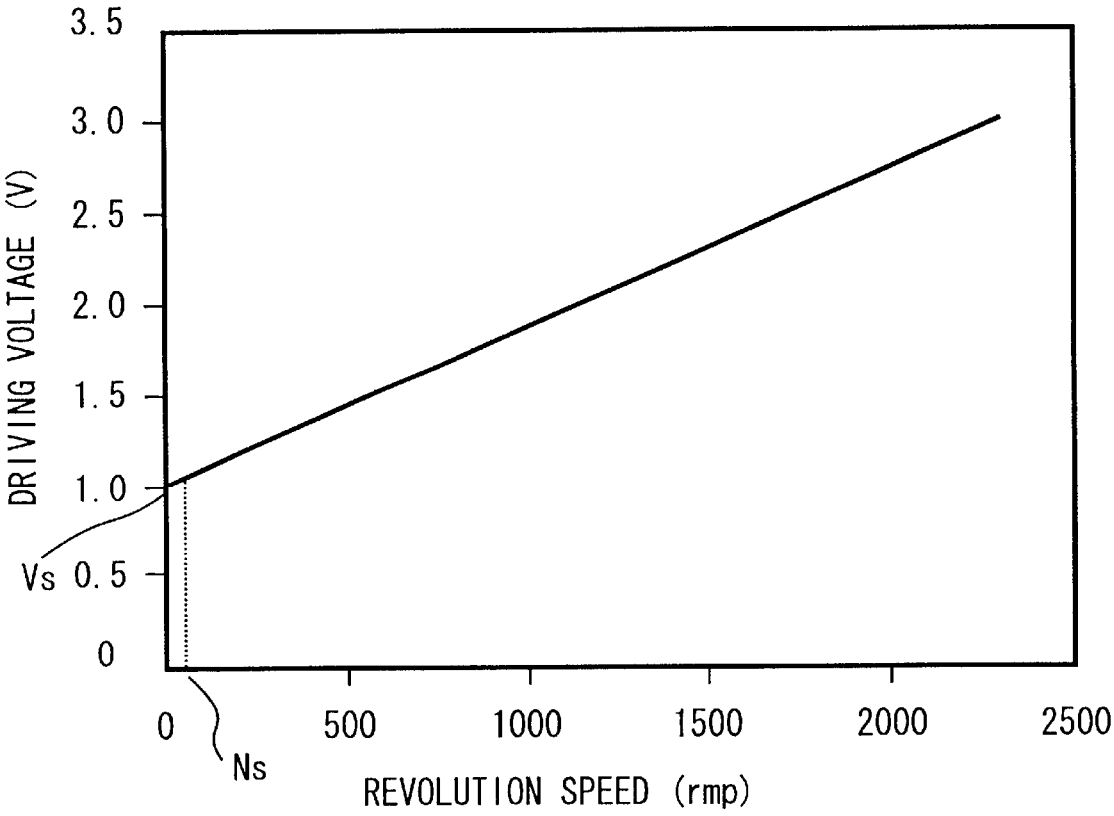
FIG. 4 is a characteristic view showing an example of the relation between the driving voltage of an ultrasonic motor and its revolution speed.

The relation between the driving voltage of the ultrasonic motor 30 and the revolution speed is as shown in FIG. 4 in which an example is shown. Thus, if the ultrasonic motor 30 exhibiting the characteristics of FIG. 4 is driven by a battery with a rated voltage of 1.5 V, the motor rotates at 600 rpm, and as the driving voltage is lowered, the revolution speed is also lowered. When the driving voltage reaches 1.0 V, the rotation of the ultrasonic motor becomes impossible. This means that the battery life comes to an end, and the voltage of 1.0 V is an actual battery life voltage in the electronic watch with the ultrasonic motor as a driving source.

Although a new battery has a rated voltage, the battery voltage is gradually lowered through use. In FIG. 4, this corresponds to the lowering of the driving voltage from the rated voltage to the battery life voltage. Thus, the revolution speed of the ultrasonic motor is also lowered correspondingly to the lowering of the battery voltage. In other words, FIG. 4 is a characteristic view in which the battery voltage is made the vertical axis and the revolution speed of the ultrasonic motor is made the horizontal axis. This characteristic curve is uniquely determined when the ultrasonic motor and the battery are determined. From the function as the driving source of the calendar display mechanism, a difference in characteristics of respective ultrasonic motors hardly becomes a problem in practical use, and similarly, a difference in characteristics of respective batteries does not become a problem. When the characteristic curve of FIG. 4 is used, from the revolution speed N of the ultrasonic motor, the driving voltage at that time, that is, the battery voltage V is obtained. This is the technical background of the invention. That is, although the actual battery residual quantity becomes 100(V−Vd)/(Vr−Vd)% when expressed in terms of the battery voltage, and it becomes 100 N/Nr% when expressed in terms of the revolution speed of the ultrasonic motor. Where, Vr designates a rated voltage of a battery; Vd, and actual battery life voltage; and Nr, a rated revolution speed corresponding to Vr. In the case where the ultrasonic motor having the characteristics of FIG. 4 is driven by a battery of 1.5 V, the rated voltage is Vr is 1.5 V, the actual battery life voltage Vd is 1.0 V, and the rated revolution speed Nr is 600 rpm.

The battery life used in the battery residual quantity display is not an actual battery life, but an apparent battery life Vs, that is, a battery voltage exceedingly close to the actual battery life voltage Vd, and this is a minimum effective battery residual quantity value expressed in terms of voltage. Thus, the battery residual quantity used in the battery residual quantity display becomes 100(V−Vs)/(Vr−Vs)% when expressed in terms of the battery voltage, and becomes 100(N−Ns)/(Nr−Ns)% when expressed in terms of the revolution speed of the ultrasonic motor. The character Ns designates a minimum effective revolution speed of the ultrasonic motor when it is driven by Vs, and a minimum effective battery residual quantity value when expressed in terms of the revolution speed. In the case where the ultrasonic motor having the characteristics of FIG. 4 is driven by a battery of 1.5 V, (Vr—Vs) is a value slightly smaller than 0.5 V, while (Nr-Ns) is a value slightly smaller than 600 rpm. The variation width of the latter is apparently larger. It is apparently easier and more certain to see the change from the battery residual quantity 100% to 0% of the battery life in a width of 600 rpm than to see the change from the battery residual quantity 100% to 0% of the battery life in a width of 0.5 V. Thus, if the battery residual quantity is detected through the revolution speed, it is possible to set the apparent battery life of a value exceedingly close to the actual battery life, that is, the minimum effective revolution speed. In summary, since the battery life is judged through the revolution speed of the ultrasonic motor, it is possible to detect the state exceedingly close to the actual battery life and to display that.

Figure 5:
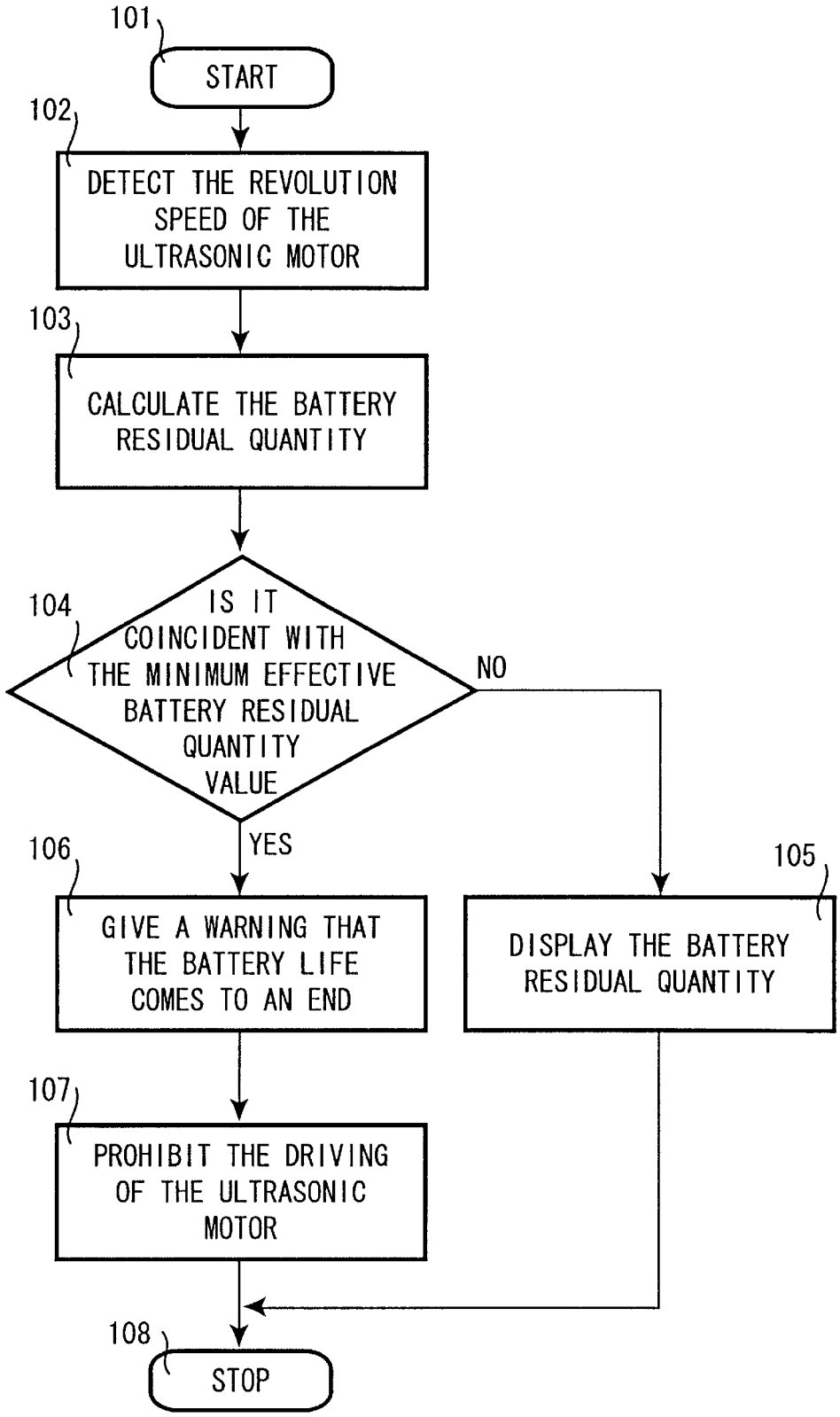
FIG. 5 is a flowchart of a battery residual quantity display processing in the electronic watch of FIG. 1.

Here, the way of making the battery residual quantity display will be described with reference to FIG. 5. In the electronic watch of FIG. 1, when the cylindrical wheel 22*b* rotates an hour hand to 23:00 and it reaches a predetermined time, a movable contact attached to the cylindrical wheel 22*b* comes in electrical contact with a fixed contact of a circuit substrate. Then the CPU 11 detects the electric contact, and gives a driving pulse to the ultrasonic motor 30. The ultrasonic motor 30 is started (101), and when it reaches a steady revolution speed, the revolution speed detector 43 detects the revolution speed N of the ultrasonic motor (102). The detected revolution speed N is stored in the revolution speed storage portion 13*a*. In the comparison data storage portion 13*b* of the RAM 13, the comparison data are already stored. The comparison data includes the rated revolution speed Nr and the minimum effective revolution speed Ns corresponding to the minimum effective battery residual quality value.

Next, the CPU 11 substitutes the revolution speed and the comparison data stored in the RAM 13 for the numerical expression of 100(N−Ns)/(Nr-Ns)%, calculates the battery residual quantity (103), and subsequently, it is judged whether the calculated battery residual quantity is coincident with the minimum effective battery residual quantity value (minimum effective revolution speed Ns) (104). As a result of the judgement, if not coincident, the CPU 11 drives the battery residual quantity display unit 42, and causes the battery residual quantity to be displayed in percent (105). As a result of the judgement, if coincident, the CPU 11 drives the alarm 45 to give a warning that the battery life has come to an end (106), and prohibits the driving of the ultrasonic motor 30 (107). When the cylindrical wheel 22*b* is further rotated, and the movable contact is separated from the fixed contact of the circuit substrate, the battery residual quantity display processing is ended (108). In this way, in the present invention, not to mention the battery life, the battery residual quantity can be always displayed on the battery residual quantity display unit 42, and the battery life can be notified by the alarm 45. Incidentally, these series of processings are carried out in accordance with the processing program stored in the ROM 12.

Although the revolution speed detector 43 used in the invention can be realized by a well-known encoder, in this embodiment, the revolution speed detector using the day rotating intermediate wheel 31*a* is adopted. That is, the revolution speed detector is constructed such that a light emitting element and a light receiving element are provided close to the upper part and the lower part of the day rotating intermediate wheel 31*a* to be opposite to each other, and the day rotating intermediate wheel 31*a* is provided with a small through hole through which light from the light emitting element passes. The revolution speed of the day rotating intermediate wheel 31*a* is obtained by reducing the revolution speed of the ultrasonic motor 30 in proportion, and a time interval at which the light receiving element receives light is in proportion to the revolution speed of the day rotating intermediate wheel 31*a*. Thus, by measuring the time interval at which the light receiving element receives light, the revolution speed of the ultrasonic motor can be detected. The revolution speed detector using the day rotating intermediate wheel 31*a* has features such that its structure is simple and the cost is low as compared with the encoder. The same revolution speed detector can also be realized by using the day rotating wheel 31*b* or the rotor 30*c* of the ultrasonic motor 30.

Although the electronic apparatus with the ultrasonic motor as the driving source according to the invention has been described while the embodiment of the electronic watch with the ultrasonic motor as the driving source of the calendar display mechanism is exemplified, it is needless to say that the invention is not limited to this embodiment. With respect to the battery residual quantity display, although the description has been made of an example in which the battery residual quantity is calculated from the revolution speed of the ultrasonic motor, it can be realized by other methods. For example, there is also such a method that the comparison data stored in the comparison data storage portion 13*b* of the RAM 13 are made a table in which the revolution speed and the battery residual quantity are displayed by contrast with each other, so that the battery residual quantity is immediately specified from the detected revolution speed and the table, and is displayed.

As described above, according to the invention, attention has been paid to the fact that the revolution speed of an ultrasonic motor driven by a battery has a definite relation to the temporal change of the battery voltage, and the battery residual quantity is judged from the revolution speed of the ultrasonic motor. That is, in the battery residual quantity display device according to the invention, comparison data corresponding to the battery residual quantity obtained from the characteristic curve between the driving voltage of the ultrasonic motor and the revolution speed are stored as reference values in the memory, and the revolution speed of the ultrasonic motor under rotation driving is detected and is compared with the comparison data, so that the battery residual quantity is judged. Thus, as compared with a conventional battery residual quantity display device using a voltage dividing circuit, not only that the circuit structure is simplified, but that it becomes possible to detect the state exceedingly close to an actual battery life and to display that. Thus, the user can exchange the battery at a suitable timing. Also with respect to the circuit design, as compared with the conventional battery residual quantity display device, it is possible to save troubles and to reduce manufacturing costs as well.

What is claimed is:

1. An electronic apparatus having an ultrasonic motor as a driving source for driving a load, a battery for driving the ultrasonic motor, and a battery residual capacity display device for displaying a residual capacity of the battery, wherein the battery residual capacity display device comprises:

a display unit for displaying the residual capacity of the battery;

a revolution speed detector for detecting a revolution speed of the ultrasonic motor;

a memory for storing comparison data; and a control circuit for comparing the detected revolution speed of the ultrasonic motor with the comparison data and for controlling the display unit to display the residual capacity of the battery on the basis of the comparison result.

2. An electronic apparatus having an ultrasonic motor as a driving source according to claim 1; further comprising an alarm controlled by the control circuit for generating an alarm when the detected revolution speed of the ultrasonic motor coincides with a minimum effective battery residual capacity value.

3. An electronic apparatus having an ultrasonic motor as a driving source according to claim 1; wherein the control circuit prohibits driving of the ultrasonic motor when the detected revolution speed coincides with a minimum effective battery residual capacity value.

4. An electronic watch having an ultrasonic motor as a driving source for driving a calendar display mechanism, a battery for driving the ultrasonic motor, and a battery residual capacity display device for displaying a residual capacity of the battery, wherein the battery residual capacity display device comprises:

a display unit for displaying the residual capacity of the battery;

a revolution speed detector for detecting a revolution speed of the ultrasonic motor;

a memory for storing comparison data; and a control circuit for comparing the detected revolution speed with the comparison data and for controlling the display unit to display the residual capacity of the battery on the basis of the comparison result.

5. An electronic watch according to claim 4; wherein the revolution speed detector detects a rotation period of one of a rotor of the ultrasonic motor or a constituent member of a transmission mechanism for transmitting a rotational force of the ultrasonic motor to the calendar display mechanism.

6. An electronic apparatus having an ultrasonic motor as a driving source according to claim 1; wherein the comparison data comprises a rated revolution speed of the ultrasonic motor Nr, at which the ultrasonic motor rotates during normal operation, and a minimum effective revolution speed of the ultrasonic motor Ns, corresponding to a minimum residual battery capacity effective to drive the ultrasonic motor at the minimum effective revolution speed.

7. An electronic apparatus having an ultrasonic motor as a driving source according to claim 6; wherein the control circuit compares the detected revolution speed with the comparison data by calculating the residual battery capacity according to the formula $$100*(N-Ns)/(Nr-Ns)\%$$

wherein N is the detected revolution speed of the ultrasonic motor.

8. An electronic apparatus having an ultrasonic motor as a driving source according to claim 1; wherein the comparison data comprises a rated revolution speed of the ultrasonic motor Nr when driven at a rated voltage of the battery.

9. An electronic apparatus having an ultrasonic motor as a driving source according to claim 6; wherein the control circuit compares the detected revolution speed with the comparison data by calculating the residual battery capacity according to the formula $$100(N/Nr)\%$$

wherein N is the detected revolution speed of the ultrasonic motor.

10. An electronic watch according to claim 4; wherein the comparison data comprises a rated revolution speed of the ultrasonic motor Nr, at which the ultrasonic motor rotates during normal operation, and a minimum effective revolution speed of the ultrasonic motor Ns, corresponding to a minimum residual battery capacity effective to drive the ultrasonic motor at the minimum effective revolution speed.

11. An electronic watch according to claim 10; wherein the control circuit compares the detected revolution speed with the comparison data by calculating the residual battery capacity according to the formula $$100*(N-Ns)/(Nr-Ns)\%$$

wherein N is the detected revolution speed of the ultrasonic motor.

12. An electronic watch according to claim 4; wherein the comparison data comprises a rated revolution speed of the ultrasonic motor Nr when driven at a rated voltage of the battery.

13. An electronic watch according to claim 12; wherein the control circuit compares the detected revolution speed with the comparison data by calculating the residual battery capacity according to the formula $$100(N/Nr)\%$$

wherein N is the detected revolution speed of the ultrasonic motor.

14. An electronic watch according to claim 4; further comprising a time display mechanism for displaying a current time.

15. An electronic watch according to claim 14; wherein the time display mechanism comprises a minute wheel for undergoing rotation once every hour, a cylindrical wheel commonly driven with the minute wheel for undergoing rotation once every twenty-four hours, a stepping motor for driving the minute wheel and the cylindrical wheel, and a speed-reducing transmission mechanism interposed between the stepping motor and a driven one of the minute wheel and the cylindrical wheel.

16. An electronic watch according to claim 15; wherein the calendar display mechanism comprises a rotating plate imprinted with date-indicating indicia for indicating a current date and having a toothed inner peripheral surface, a hinged jumper for engaging with a tooth of the plate to prevent rotation of the plate until a change in the current date occurs, the ultrasonic motor for driving the plate to rotate to indicate the current date, and a transmission mechanism interposed between the ultrasonic motor and the plate for driving the plate and the jumper.

17. An electronic watch according to claim 16; wherein the transmission mechanism comprises an intermediate wheel driven by the ultrasonic motor and a day rotating wheel for undergoing rotation once each twenty-four hours driven by the intermediate wheel for controlling the jumper to disengage from the plate when the current date changes so that the plate can be advanced.

18. An electronic watch according to claim 17; wherein a rotating member of the ultrasonic motor engages with the day rotating wheel of the calendar display mechanism.

19. An electronic watch according to claim 17; wherein the control circuit comprises a CPU, a ROM for storing a program executed by the CPU, a RAM for data storage, a reference pulse generating circuit for generating a reference pulse for driving the CPU, a stepping motor driving circuit controlled by the CPU for driving the stepping motor, a driving pulse generating circuit for generating an ultrasonic pulse signal, and an ultrasonic motor driving circuit for receiving the ultrasonic pulse and driving the ultrasonic motor.

20. An electronic watch according to claim 19; further comprising an alarm circuit controlled by the CPU for generating an alarm when the detected revolution speed of the ultrasonic motor coincides with a minimum effective resolution speed to indicate battery depletion.

21. An electronic watch according to claim 19; wherein the RAM includes a revolution speed storing section for storing the detected revolution speed of the ultrasonic motor and a comparison data storing section for storing the comparison data.

22. An electronic watch according to claim 4; wherein the revolution speed detector comprises an encoder.

23. An electronic timepiece comprising: a first display mechanism for displaying at least one of a current time and date; a second display mechanism for displaying residual battery capacity; a drive mechanism having a battery and a motor for driving the first and second display mechanisms; a motor speed detector for detecting a rotating speed of the motor; and a control circuit for calculating the residual battery life based on the detected rotating speed of the motor and comparison data representing a relationship between the detected rotating speed and the residual battery life.

24. An electronic timepiece according to claim 23; wherein the first display mechanism comprises a time display mechanism for displaying a current time and a date display mechanism for displaying a current date; and the drive mechanism comprises a time display mechanism for driving the time display mechanism and a date display drive mechanism for driving the date display mechanism, and the motor comprises an ultrasonic motor for driving the date display mechanism.

25. An electronic timepiece according to claim 23; wherein the comparison data comprises a rated revolution speed of the ultrasonic motor Nr, at which the ultrasonic motor rotates during normal operation, and a minimum effective revolution speed of the ultrasonic motor Ns, corresponding to a minimum residual battery capacity effective to drive the ultrasonic motor at the minimum effective revolution speed.

26. An electronic timepiece according to claim 25; wherein the control circuit compares the detected revolution speed with the comparison data by calculating the residual battery capacity according to the formula $$100*(N-Ns)/(Nr-Ns)\%$$

wherein N is the detected revolution speed of the ultrasonic motor.

27. An electronic timepiece according to claim 23; wherein the comparison data comprises a rated revolution speed of the ultrasonic motor Nr when driven at a rated voltage of the battery.

28. An electronic timepiece according to claim 27; wherein the control circuit compares the detected revolution speed with the comparison data by calculating the residual battery capacity according to the formula $$100(N/Nr)\%$$

wherein N is the detected revolution speed of the ultrasonic motor.

* * * * *